US012390685B2

(12) United States Patent
Chuang

(10) Patent No.: US 12,390,685 B2
(45) Date of Patent: Aug. 19, 2025

(54) MULTIFUNCTIONAL CORE TRAINING DEVICE

(71) Applicant: Lung-Fei Chuang, Taichung (TW)

(72) Inventor: Lung-Fei Chuang, Taichung (TW)

( * ) Notice: Subject to any disclaimer, the term of this patent is extended or adjusted under 35 U.S.C. 154(b) by 95 days.

(21) Appl. No.: 18/419,578

(22) Filed: Jan. 23, 2024

(65) Prior Publication Data

US 2024/0399200 A1 Dec. 5, 2024

(30) Foreign Application Priority Data

May 30, 2023 (CN) ..... 202321340702.5

(51) Int. Cl.
*A63B 23/02* (2006.01)
*A63B 21/00* (2006.01)

(52) U.S. Cl.
CPC ..... *A63B 23/0216* (2013.01); *A63B 23/0211* (2013.01); *A63B 21/00185* (2013.01); *A63B 21/4035* (2015.10); *A63B 2225/09* (2013.01)

(58) Field of Classification Search
CPC ..... A63B 23/0216; A63B 23/0211; A63B 21/00185; A63B 21/4035; A63B 2225/09; A63B 2210/50; A63B 2210/58; A63B 21/00061; A63B 21/00065; A63B 21/0428; A63B 21/4031; A63B 21/4033; A63B 21/4039; A63B 22/205; A63B 23/03525; A63B 21/0552; A63B 23/0205; A63B 22/0076; A63B 2209/08
See application file for complete search history.

(56) References Cited

U.S. PATENT DOCUMENTS 4,004,801 A * 1/1977 Campanaro ..... A63B 22/0087 403/14
4,383,684 A * 5/1983 Schliep ..... A63B 21/0628 482/133
4,911,438 A * 3/1990 Van Straaten ..... A63B 21/068 482/130
5,967,955 A * 10/1999 Westfall ..... A63B 21/154 482/142
D612,000 S * 3/2010 Campanaro ..... D21/687
9,028,375 B2 * 5/2015 Ho ..... A63B 23/0216 482/142
9,028,376 B2 * 5/2015 Ho ..... A63B 22/14 482/142
2009/0018000 A1 * 1/2009 Brown ..... A63B 21/068 482/140

(Continued)

*Primary Examiner* — Andrew S Lo
(74) *Attorney, Agent, or Firm* — CKC & Partners Co., LLC

(57) ABSTRACT

A multifunctional core training device includes a first frame body, a second frame body, a holding device, two elastic elements, two forcing elements, a sliding structure, and a switch. The second frame body is pivotally disposed on the first frame body. The holding device is disposed on the first frame body. The two elastic elements are disposed on the first frame body. The two forcing elements are respectively connected to the two elastic elements. The sliding structure is movably disposed on the first frame body. The switch is disposed on the sliding structure and is for positioning a position of the sliding structure relative to the first frame body. When the second frame body pivots relative to the first frame body, the relative position of the first frame body and the second frame body is changed.

16 Claims, 18 Drawing Sheets

(56) References Cited

U.S. PATENT DOCUMENTS

| | | | | |
|---|---|---|---|---|
| 2014/0005006 | A1* | 1/2014 | Ho | A63B 22/14 482/96 |
| 2014/0005008 | A1* | 1/2014 | Ho | A63B 22/205 482/96 |
| 2025/0010128 | A1* | 1/2025 | Chiang | A63B 22/0076 |

* cited by examiner

100

MULTIFUNCTIONAL CORE TRAINING DEVICE

RELATED APPLICATIONS

This application claims priority to China Application Serial Number 202321340702.5, filed May 30, 2023, which is herein incorporated by reference.

BACKGROUND

Technical Field

The present disclosure relates to a fitness-training device. More particularly, the present disclosure relates to a multi-functional core training device capable of changing exercise modes for core training.

Description of Related Art

Core muscles are located in the center of the human trunk and are for protecting the spine. The core muscles surround the waist, the abdomen, and the trunk center to the pelvic floor and are composed of deep muscles and superficial muscles in different parts of the body. During exercise, the core muscles contract before taking an action to stabilize the body axis, so that an injury caused by the lumbar spine displacement during the action is prevented. Therefore, the strength of the core muscles is very important for the human health and the physical flexibility.

To increase the strength of the core muscles, many different types of fitness devices for training the waist and the abdomen have been launched to markets, and a user can perform a strength training for different muscles. Thus, the aforementioned fitness devices become very popular. However, the conventional fitness devices have only one exercise mode, and the user needs to prepare extra-devices for performing a variety of exercising. Accordingly, the cost spent on fitness will be raised, and it requires more space for simultaneously using different fitness devices.

In order to solve such the aforementioned problems, a fitness device with multi-function is provided on the market. However, the fitness device with multi-function is heavier, and more space must be occupied when using different fitness modes. Thus, such the fitness device is not as convenient as predict.

Therefore, how to provide a fitness device that is easy to use and has different exercise modes for core training is a technical subject with commercial value.

SUMMARY

According to one aspect of the present disclosure, a multifunctional core training device includes a first frame body, a second frame body, a holding device, two elastic elements, two forcing elements, a sliding structure, and a switch. The first frame body includes a pivoting device. The second frame body is pivotally disposed on the first frame body and includes a pivoting portion and a distal portion, and the pivoting portion is pivotally disposed on the pivoting device. The holding device is disposed on one end portion of the first frame body. The two elastic elements are disposed on the first frame body. The two forcing elements are respectively connected to the two elastic elements, wherein each of the two forcing elements is connected to one end of one of the two elastic elements, and the other end of the one of the two elastic elements is connected to the first frame body. The sliding structure is movably disposed on the first frame body. The switch is disposed on the sliding structure, wherein the switch is for positioning a position of the sliding structure relative to the first frame body. When the second frame body pivots relative to the first frame body along a first circumferential direction with the pivoting device as an axis center, the distal portion of the second frame body gradually approaches the first frame body, so that the first frame body and the second frame body are arranged side by side, and then the sliding structure moves reciprocally along a major axis of the first frame body. When the second frame body pivots relative to the first frame body along a second circumferential direction with the pivoting device as the axis center, the distal portion of the second frame body is gradually away from the first frame body, so that the other end portion of the first frame body and the distal portion of the second frame body respectively abut against a ground, and then the sliding structure moves reciprocally along the major axis of the first frame body or is positioned on the first frame body.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
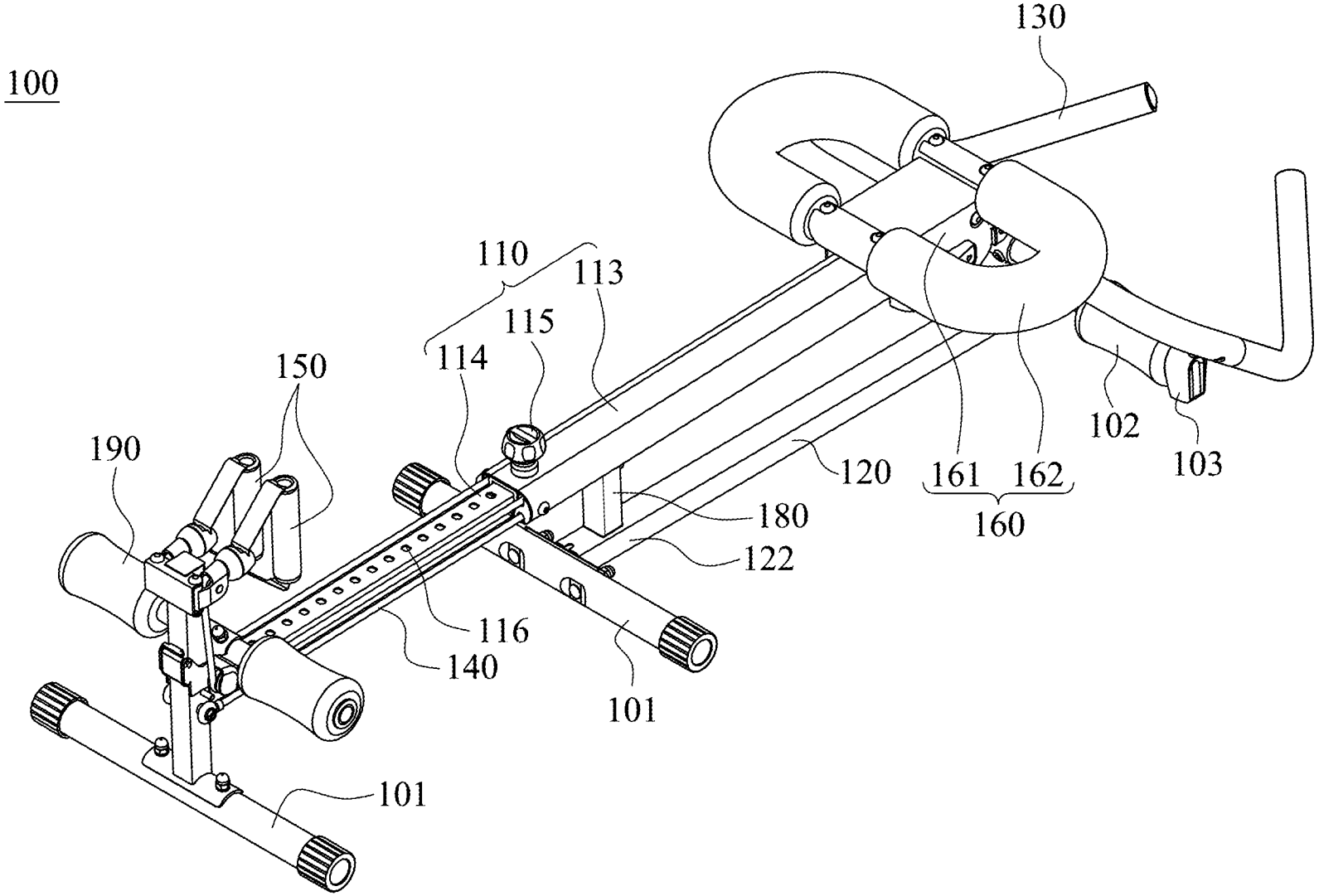
FIG. 1 is a three-dimensional schematic view of a multifunctional core training device according to the first embodiment of the present disclosure.

The present disclosure will be further exemplified by the following specific embodiments. However, the embodiments can be applied to various inventive concepts and can be embodied in various specific ranges. The specific embodiments are only for the purposes of description and are not limited to these practical details thereof. Furthermore, in order to simplify the drawings, some conventional structures and elements will be illustrated in the drawings by a simple and schematic way. The duplicated elements may be denoted by the same number or similar numbers.

Figure 2:
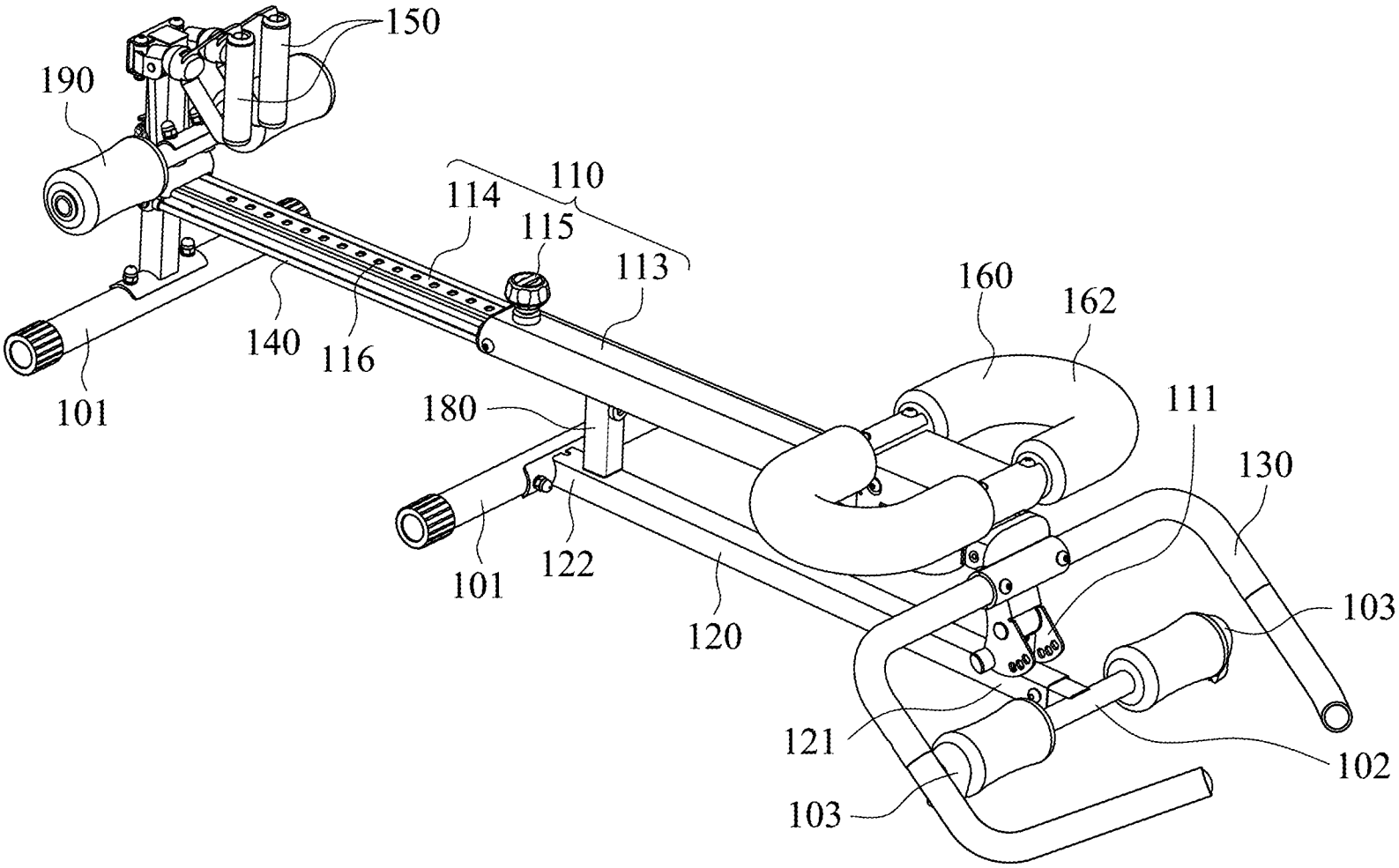
FIG. 2 is another three-dimensional schematic view of the multifunctional core training device of FIG. 1.
Figure 3:
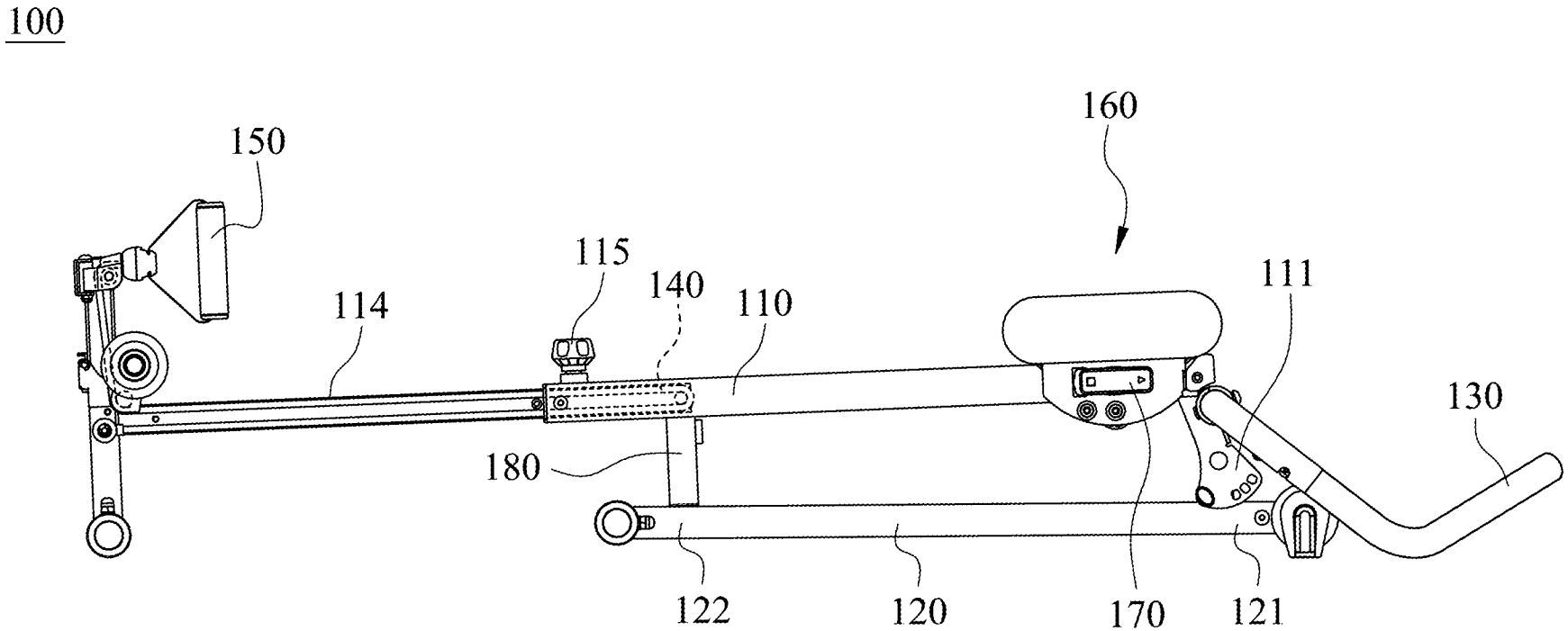
FIG. 3 is a side view of the multifunctional core training device of FIG. 1.

Reference is made to FIG. 1, FIG. 2, and FIG. 3. FIG. 1 is a three-dimensional schematic view of a multifunctional core training device 100 according to the first embodiment of the present disclosure. FIG. 2 is another three-dimensional schematic view of the multifunctional core training device 100 of FIG. 1. FIG. 3 is a side view of the multifunctional core training device 100 of FIG. 1. The multifunctional core training device 100 includes a first frame body 110, a second frame body 120, a holding device 130, two elastic elements 140, two forcing elements 150, a sliding structure 160, and a switch 170.

The first frame body 110 includes a pivoting device 111. As shown in FIG. 2 and FIG. 3, the pivoting device 111 can be located at one end portion of the first frame body 110 or be disposed close to the end portion of the first frame body 110 so as to facilitate the pivoting connection between the first frame body 110 and the second frame body 120.

The second frame body 120 is pivotally disposed on the first frame body 110 and includes a pivoting portion 121 and a distal portion 122, and the pivoting portion 121 is pivotally disposed on the pivoting device 111.

The holding device 130 is disposed on the end portion of the first frame body 110. As shown in FIG. 1 to FIG. 3, the holding device 130 can be disposed adjacent to the pivoting device 111, and the holding device 130 can be integrally bent to form two holding portions (reference number is omitted) for holding by a user. Further, as shown in FIG. 1 and FIG. 2, the multifunctional core training device 100 can further include a handle member 102. The handle member 102 is disposed on the second frame body 120 and is close to the pivoting portion 121, and the holding device 130 and the handle member 102 can be held by the user when the user performs different exercises. Thus, the exercise effect of the user and the usage safety of the multifunctional core training device 100 can be enhanced, but the present disclosure is not limited thereto.

The two elastic elements 140 are disposed on the first frame body 110, and the two forcing elements 150 are respectively connected to the two elastic elements 140, wherein each of the two forcing elements 150 is connected to one end of one of the two elastic elements 140, and the other end of the one of the two elastic elements 140 is connected to the first frame body 110. Particularly, in the multifunctional core training device 100, the two elastic elements 140 can be two elastic cords, and the two elastic elements 140 can extend along a major axis of the first frame body 110 and be respectively disposed on two sides of the first frame body 110. Thus, both hands of the user can respectively hold the two forcing elements 150 to drive the two elastic elements 140 to stretch, and the user can utilize the elastic restoring force of the two elastic elements 140 to perform reciprocating stretching exercise.

Figure 4:
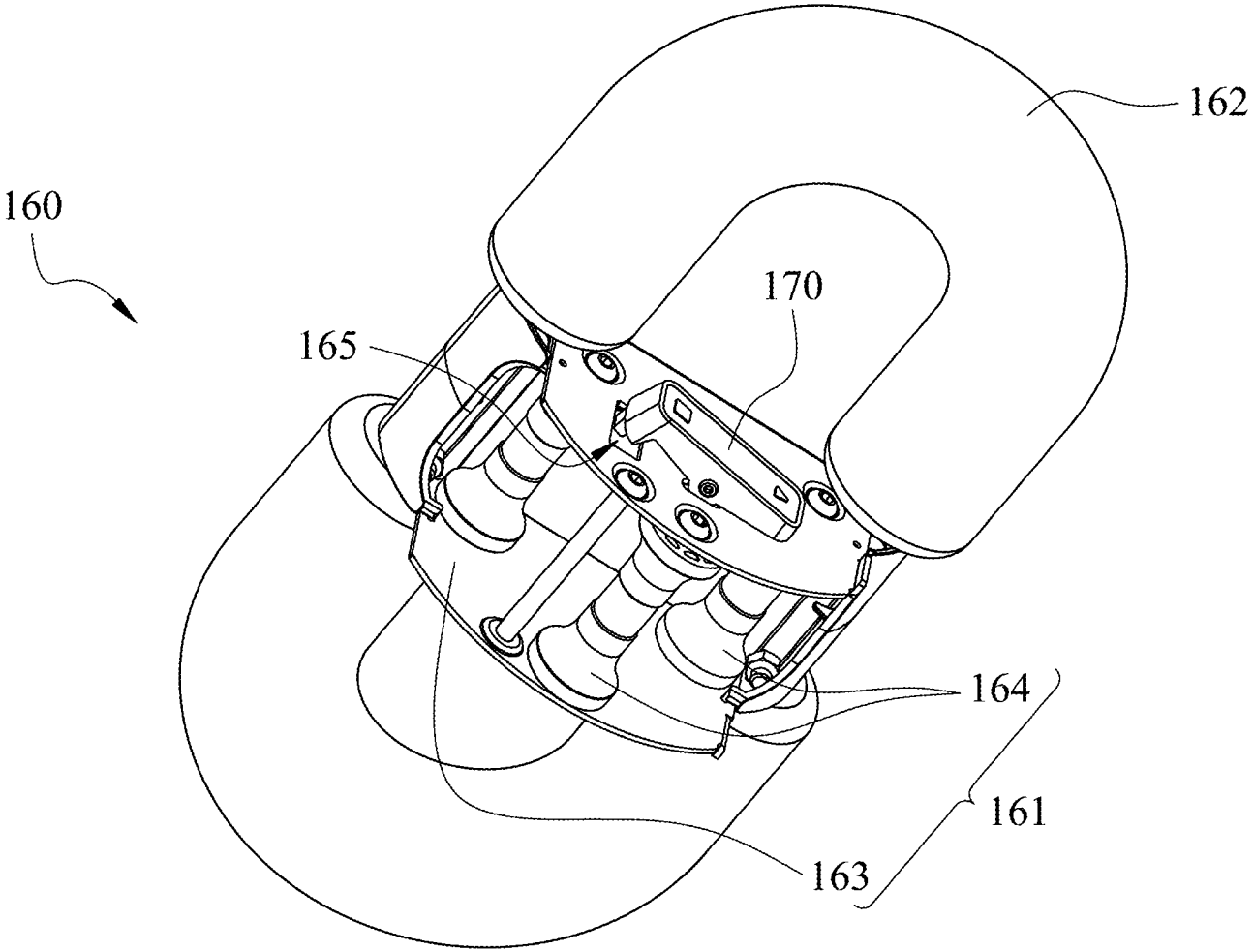
FIG. 4 is a three-dimensional schematic view of a sliding structure of the multifunctional core training device of FIG. 1.

The sliding structure 160 is movably disposed on the first frame body 110. Reference is made to FIG. 4, which is a three-dimensional schematic view of the sliding structure 160 of the multifunctional core training device 100 of FIG. 1. In the multifunctional core training device 100, the sliding structure 160 can include a sliding base 161 and a seat cushion 162.

Figure 9:
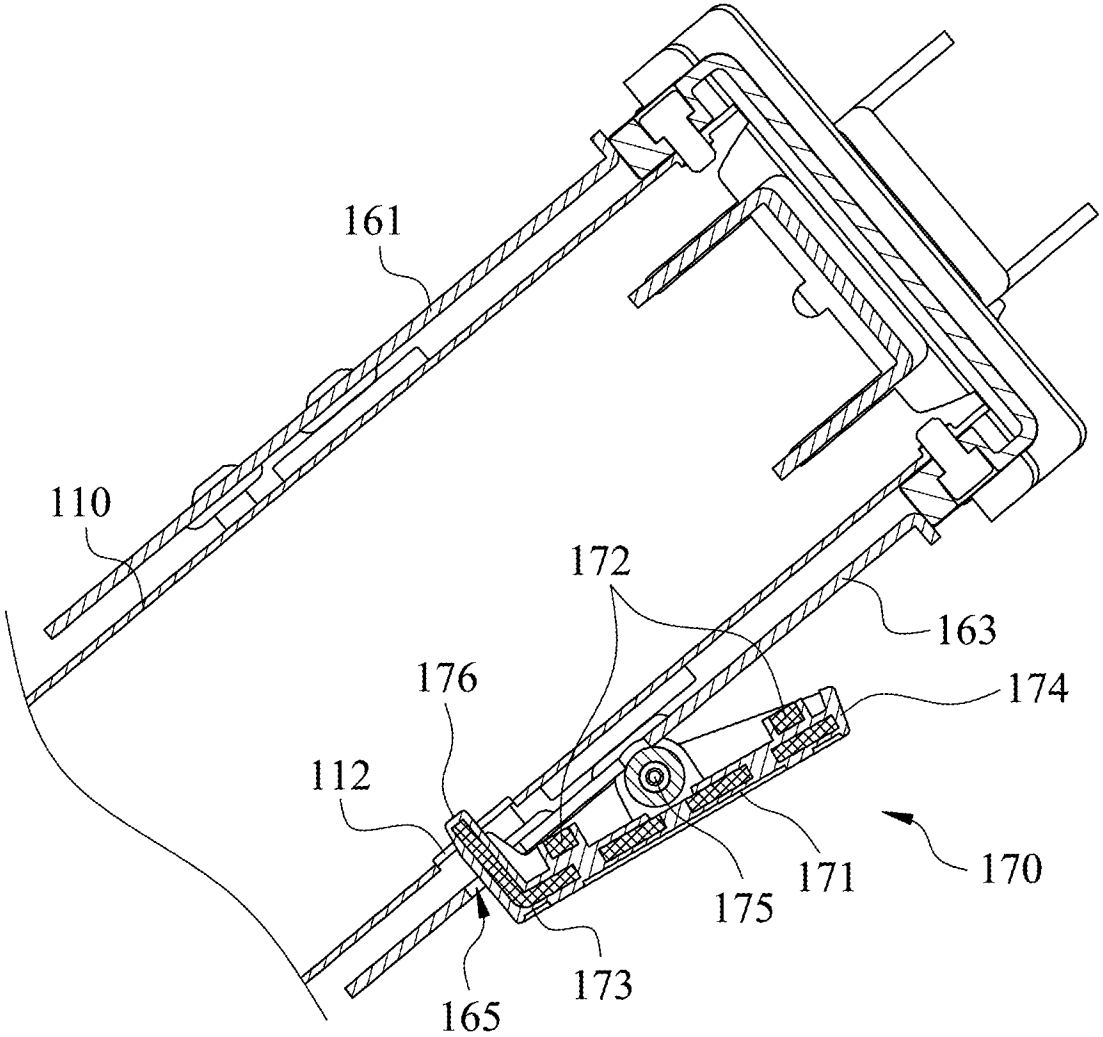
FIG. 9 is a cross-sectional view of the switch of FIG. 8 at a first position.
Figure 10:
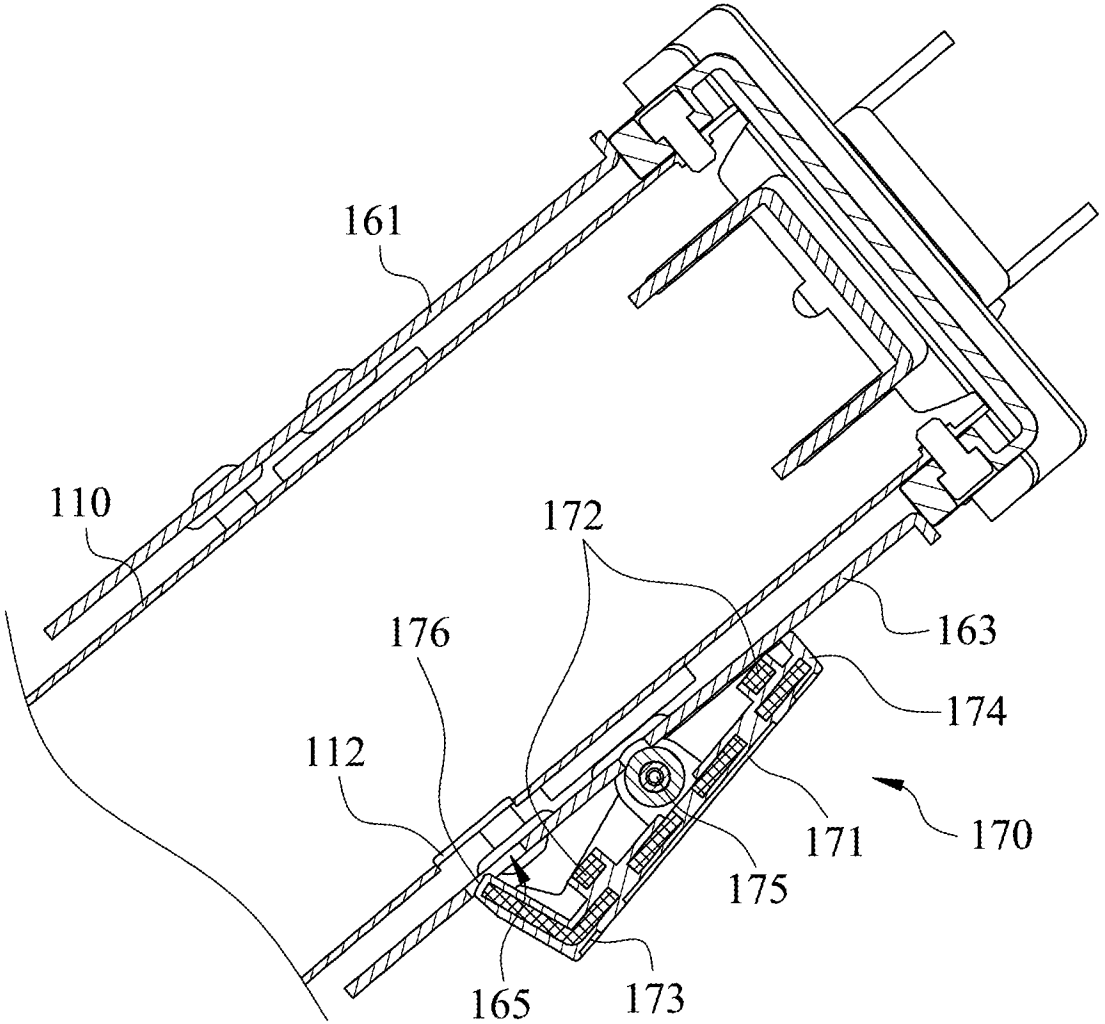
FIG. 10 is a cross-sectional view of the switch of FIG. 8 at a second position.

The sliding base 161 can include a sliding base mainbody 163 and at least two pulleys 164. The sliding base mainbody 163 has an opening 165 (as shown in FIG. 4, FIG. 9, and FIG. 10), and the sliding base mainbody 163 is movably disposed on the first frame body 110. The at least two pulleys 164 are disposed in the sliding base mainbody 163, and the at least two pulleys 164 can be located between the sliding base mainbody 163 and the first frame body 110. The seat cushion 162 is disposed on the sliding base 161. In detail, a number of the pulleys 164 in the embodiment of FIG. 4 is three, wherein two of the three pulleys 164 are located between the sliding base mainbody 163 and the first frame body 110, and another one of the three pulleys 164 is located on another side of the first frame body 110. In other words, the first frame body 110 is located in an accommodating space (reference number is omitted) of the sliding base mainbody 163 and is restricted by the three pulleys 164. At that time, the sliding base 161 can slide on the first frame body 110 by the three pulleys 164, and the reciprocating movements of the sliding structure 160 on the first frame body 110 can be smoother.

The switch 170 is disposed on the sliding structure 160, and the switch 170 is for positioning a position of the sliding structure 160 relative to the first frame body 110.

Figure 5:
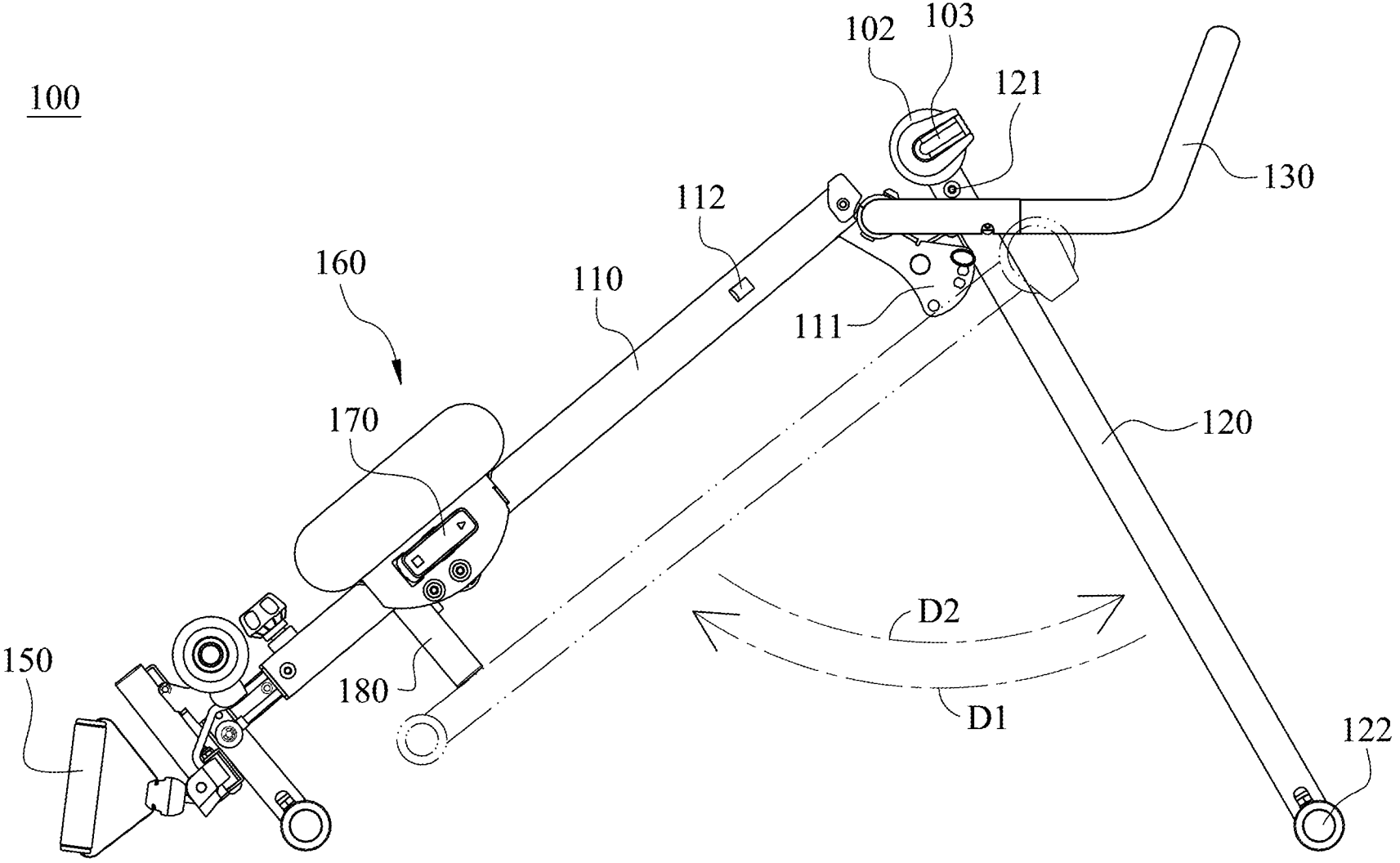
FIG. 5 is an operational schematic view of the multifunctional core training device of FIG. 1 during adjusting exercise modes.
Figure 6:
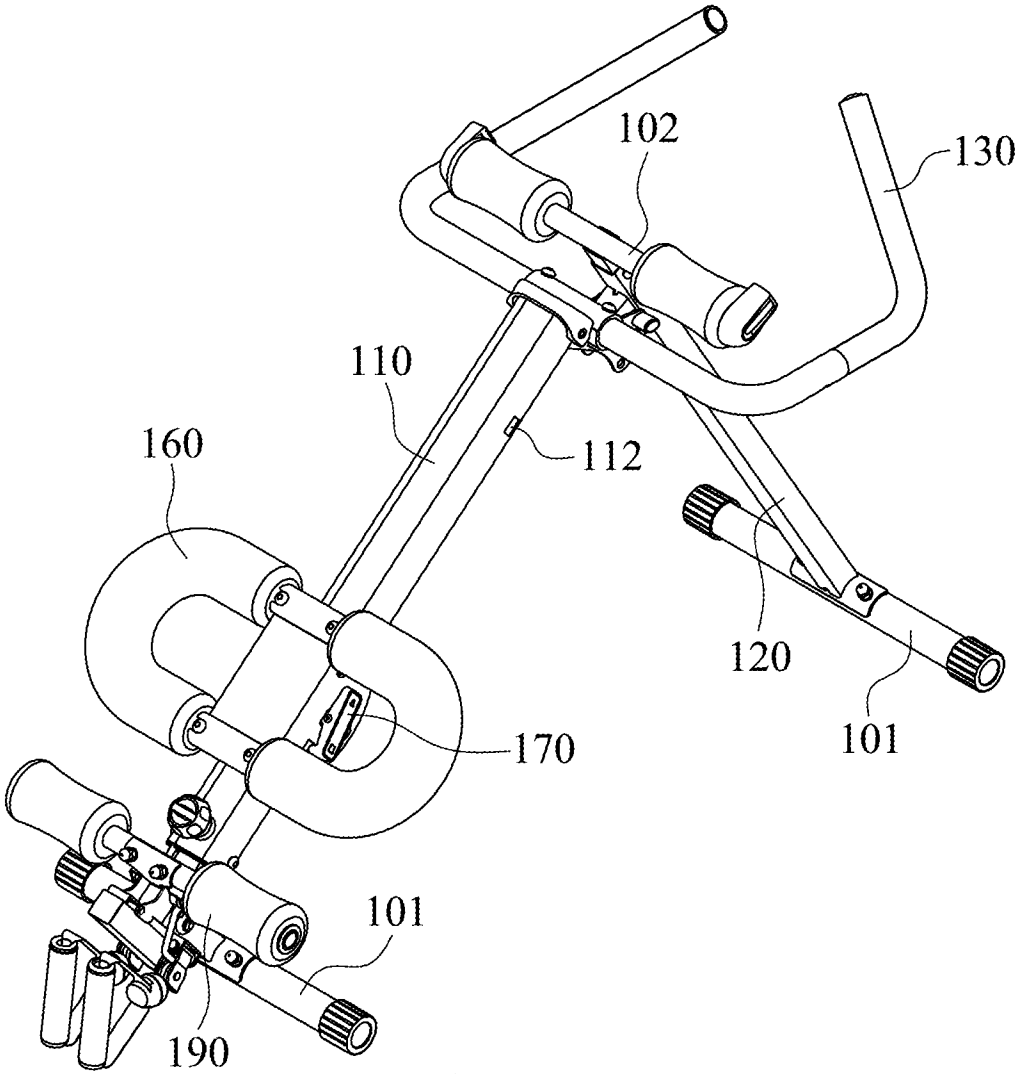
FIG. 6 is a three-dimensional schematic view of the multifunctional core training device of FIG. 1 in a mode of abdominal muscle training device.
Figure 7:
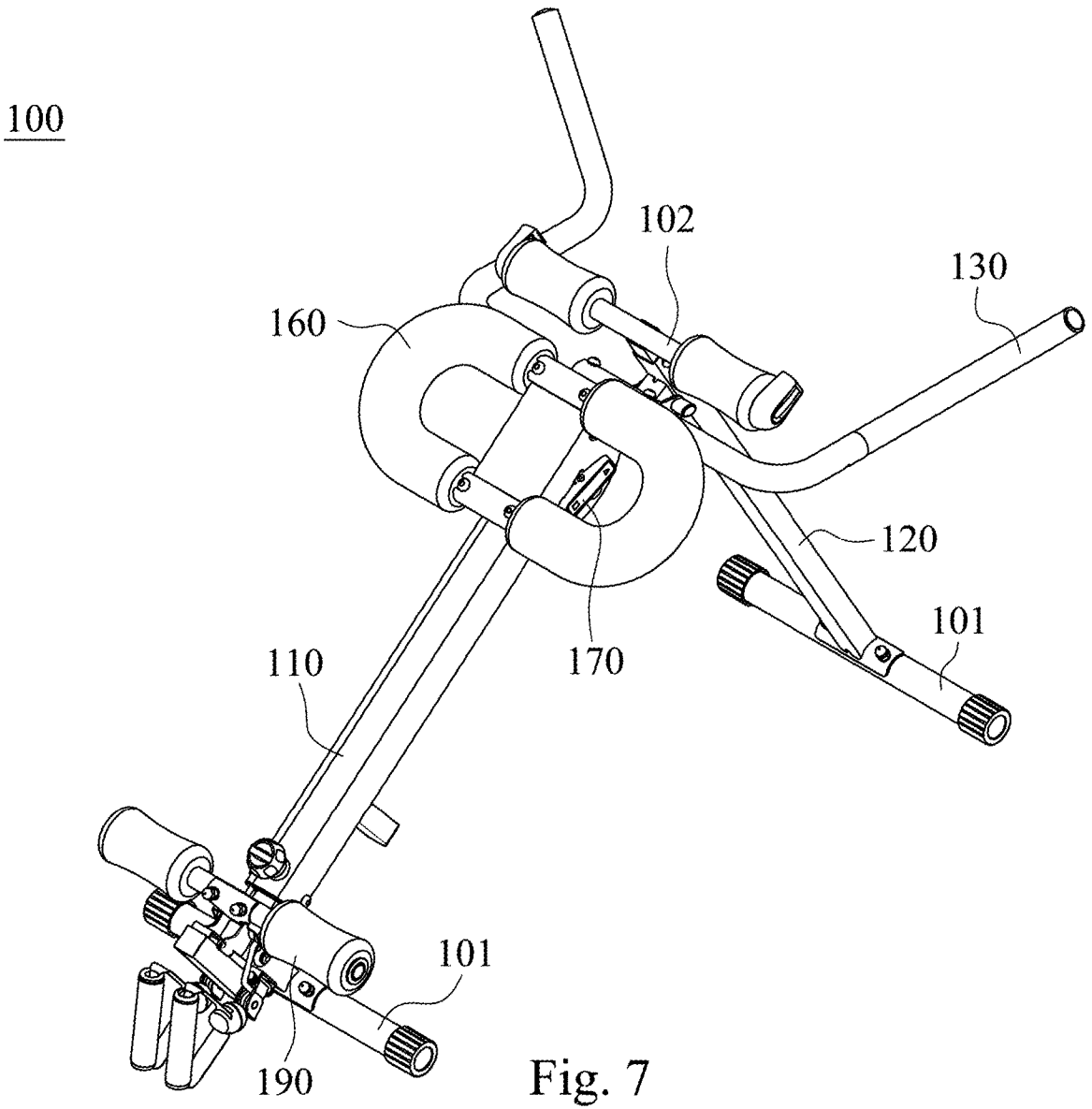
FIG. 7 is a three-dimensional schematic view of the multifunctional core training device of FIG. 1 in a mode of Roman chair.

Reference is made to FIG. 1, FIG. 5, FIG. 6, and FIG. 7. FIG. 5 is an operational schematic view of the multifunctional core training device 100 of FIG. 1 during adjusting exercise modes. FIG. 6 is a three-dimensional schematic view of the multifunctional core training device 100 of FIG. 1 in a mode of abdominal muscle training device. FIG. 7 is a three-dimensional schematic view of the multifunctional core training device 100 of FIG. 1 in a mode of Roman chair. In particular, the multifunctional core training device 100 of FIG. 1 is in a mode of rowing machine, and the user can sit on the seat cushion 162 of the sliding structure 160 and hold the two forcing elements 150 respectively with the both hands so as to pull the two forcing elements 150 to drive the two elastic elements 140 to stretch. At the same time, the user can move the body to drive the sliding structure 160 to move reciprocally relative to the first frame body 110 so as to simulate the situation of holding paddles with both hands and the body rising and falling with the water flow during sliding, thereby achieving the exercise effect of rowing.

Further, when the user wants to change the exercise modes of the multifunctional core training device 100, as shown in FIG. 5, the user can move the second frame body 120 to allow the second frame body 120 to pivot relative to the first frame body 110 with the pivoting device 111 as an axis center, so that the relative position of the first frame body 110 and the second frame body 120 is changed, and different exercise modes of the multifunctional core training device 100 can be changed. In detail, when the second frame body 120 pivots relative to the first frame body 110 along a first circumferential direction D1 with the pivoting device 111 as the axis center, the distal portion 122 of the second frame body 120 gradually approaches the first frame body 110, so that the first frame body 110 and the second frame body 120 are arranged side by side, and then the multifunctional core training device 100 is in the mode of rowing machine as shown in FIG. 1. Accordingly, the sliding structure 160 can move reciprocally along the major axis of the first frame body 110.

Furthermore, as shown in FIG. 5, the user can also move the second frame body 120 to allow the second frame body 120 to pivot relative to the first frame body 110 along a second circumferential direction D2 with the pivoting device 111 as the axis center, and the distal portion 122 of the second frame body 120 is gradually away from the first frame body 110, so that the other end portion of the first frame body 110 and the distal portion 122 of the second frame body 120 respectively abut against a ground. At that time, a horizontal height of the multifunctional core training device 100 relative to the ground is increased, and the first frame body 110 and the second frame body 120 can be used as two supporting stands of the multifunctional core training device 100, so that the user can perform different modes of exercise.

As shown in FIG. 6, when the horizontal height of the multifunctional core training device 100 relative to the ground is increased, the sliding structure 160 can move reciprocally along the major axis of the first frame body 110. Since the major axis of the first frame body 110 relative to the ground has an inclined angle, the user can kneel and sit on the seat cushion 162 of the sliding structure 160 and hold the holding device 130 or the handle member 102 with both hands to drive the legs to move by the core muscles. Accordingly, the sliding structure 160 can be driven to move reciprocally relative to the first frame body 110 so as to simulate an exercise mode of abdominal muscle training device on the market for training the core muscles.

As further shown in FIG. 7, when the switch 170 is turned on to position the sliding structure 160 to one end different from the ground of the first frame body 110, the user can lean on the seat cushion 162 with the abdomen facing the sliding structure 160 and then keep the upper body hanging in the air. Then, the user can move the body to drive the upper body to move by the core muscles so as to simulate an exercise mode of Roman chair on the market for training the core muscles. Furthermore, the holding device 130 can also be adjusted so that both ends of the holding device 130 can extend outward to facilitate the holding by the user with both hands, but the present disclosure is not limited thereto.

Therefore, by the arrangement that the second frame body 120 can pivot relative to the first frame body 110 to change the position of the first frame body 110 relative to the second frame body 120, and the sliding structure 160 is movably disposed on the first frame body 110 or is positioned on the first frame body 110 by the switch 170, the multifunctional core training device 100 of the present disclosure can change the exercise modes according to the actual training needs, so that the multifunctional core training device 100 of the present disclosure can be used as a rowing machine, an abdominal muscle training device, or a Roman chair to do exercises for training different muscles of the core muscles. Thus, the convenience of use and the breadth of applications of the multifunctional core training device 100 of the present disclosure can be enhanced.

Further, in the embodiment of FIG. 1, the multifunctional core training device 100 can further include two supporting rods 101, wherein one of the two supporting rods 101 is disposed on the other end portion of the first frame body 110, and the other one of the two supporting rods 101 is disposed on the distal portion 122 of the second frame body 120. By the arrangement of the two supporting rods 101, the support stability of the first frame body 110 and the second frame body 120 on the ground can further be enhanced. Furthermore, in the multifunctional core training device 100, two ends of the two supporting rods 101 can respectively have a skidproof sheath (reference number is omitted), and the displacement of the multifunctional core training device 100 during exercise by the user can be prevented. Therefore, the usage safety of the multifunctional core training device 100 can be enhanced, but the present disclosure is not limited thereto.

Reference is made to FIG. 1 and FIG. 2. The handle member 102 can further include two supporting elements 103, and the two supporting elements 103 are respectively disposed on two ends of the handle member 102. In particular, each of the two supporting elements 103 can include a planar structure (reference number is omitted), wherein when the multifunctional core training device 100 is in the mode of rowing machine, the first frame body 110 and the second frame body 120 are arranged side by side, and the handle member 102 is supported on the ground because the second frame body 120 pivots relative to the first frame body 110. At the same time, the two supporting elements 103 can further abut against the ground by the planar structure thereof, so that the stability of the multifunctional core training device 100 can be enhanced, and the displacement of the multifunctional core training device 100 during the rowing exercise of the user can be prevented.

As further shown in FIG. 1, FIG. 2, and FIG. 3, the multifunctional core training device 100 can further include a positioning rod 180. The positioning rod 180 is disposed on one side different from the sliding structure 160 of the first frame body 110, wherein when the first frame body 110 and the second frame body 120 are arranged side by side to allow the multifunctional core training device 100 in the mode of rowing machine, two ends of the positioning rod 180 respectively abut against the first frame body 110 and the second frame body 120 so as to prevent the second frame body 120 from excessively pivoting relative to the first frame body 110. Therefore, the stability and the usage safety of the multifunctional core training device 100 during the rowing exercise of the user can be enhanced.

As further shown in FIG. 1 and FIG. 2, the first frame body 110 can further include a housing element 113, a first frame element 114, and a positioning element 115. The housing element 113 has a through hole (reference number is omitted). The first frame element 114 is telescopically disposed in the housing element 113, and the first frame element 114 includes at least two penetrating holes 116. The positioning element 115 passes through the through hole and one of the at least two penetrating holes 116 in sequence so as to position the position of the first frame element 114 relative to the housing element 113. Therefore, by the arrangement that the positioning element 115 is disposed in the different penetrating holes 116, the position of the first frame element 114 relative to the housing element 113 can be adjusted, the demands of different users can be satisfied, and the breadth of applications of the multifunctional core training device 100 of the present disclosure can be enhanced.

Furthermore, as shown in FIG. 1, FIG. 2, and FIG. 3, the two elastic elements 140 can also extend along the major axis of the first frame body 110 and be disposed on the first frame element 114, wherein the two elastic elements 140 are located in the housing element 113. In particular, each of the two elastic elements 140 can extend from one end portion (reference number is omitted) close to the forcing elements 150 of the first frame element 114 toward the sliding structure 160 and be disposed on the first frame element 114, and then each of the two elastic elements 140 can be rotated at one end portion (reference number is omitted) different from the forcing elements 150 of the first frame element 114 and extend along the major axis of the first frame body 110 and be disposed on the first frame element 114. Thus, the other end portion of each of the two elastic elements 140 is connected to the first frame body 110. Therefore, the breakage of the two elastic elements 140 due to being pulled by other elements during movement can be prevented, and the sufficient length and space for stretching and restoration of the two elastic elements 140 can be obtained, so that the use of the multifunctional core training device 100 of the present disclosure can be safer, and the exercise performance of the user by using the multifunctional core training device 100 of the present disclosure can be enhanced.

As further shown in FIG. 1 and FIG. 2, the multifunctional core training device 100 of the present disclosure can also include a bottom rod 190. The bottom rod 190 is disposed on the other end of the first frame body 110. When the user performs a rowing exercise, both feet of the user can rest on the bottom rod 190 to stabilize the body and maintain balance. Further, when the user exercises in the mode of abdominal muscle training device or the mode of Roman chair, as shown in FIG. 6 and FIG. 7, the bottom rod 190 can assist the user to maintain balance when the user kneels sitting or leans in front of the sliding structure 160, but the present disclosure is not limited thereto.

Furthermore, although it is not shown in the figures, the multifunctional core training device of the present disclosure can include a count displayer. The count displayer can be disposed on the first frame body so as to count a number of actions and an exercise time of the user, but the present disclosure is not limited thereto.

Figure 8:
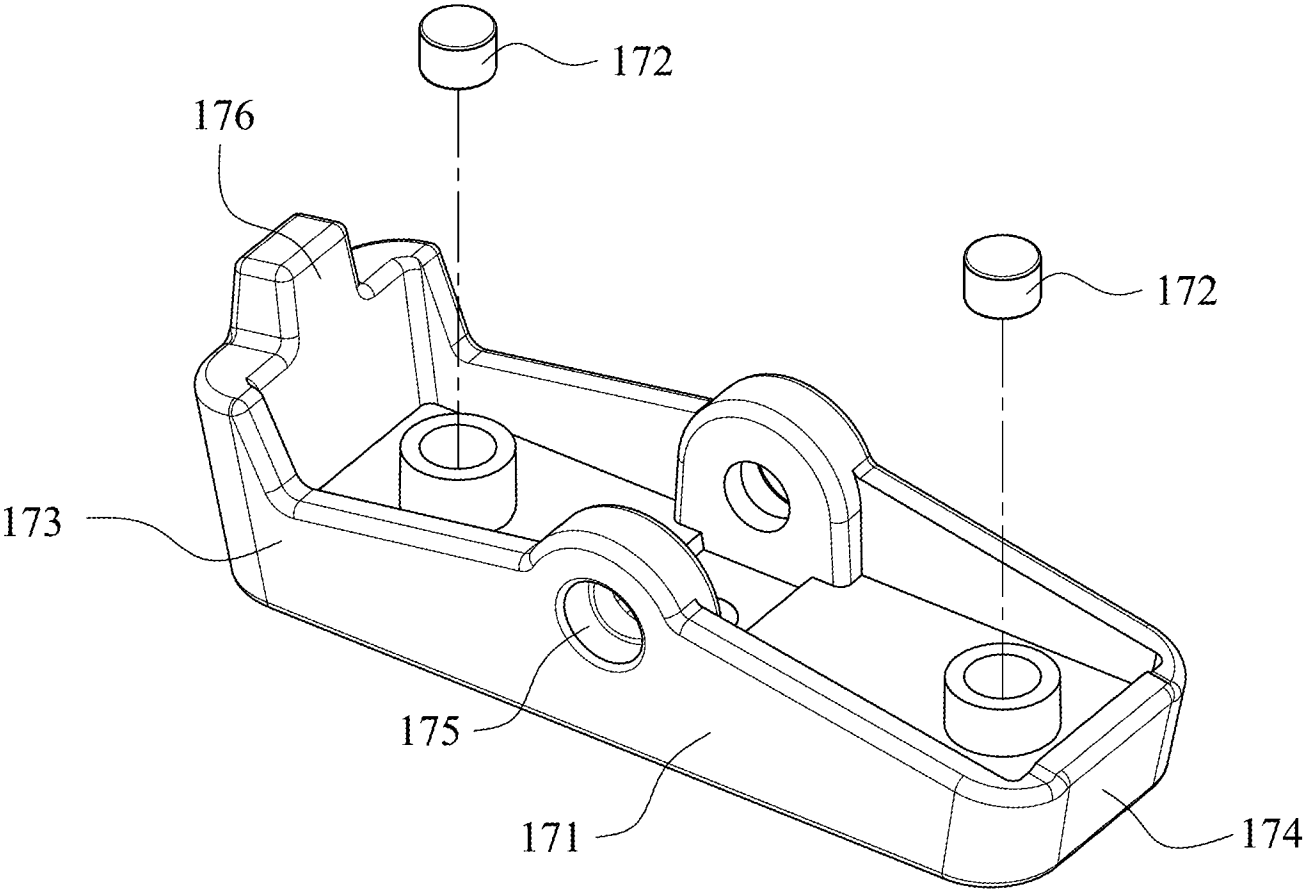
FIG. 8 is a schematic view of one switch of the multifunctional core training device of FIG. 1.

Reference is made to FIG. 1, FIG. 4, FIG. 5, FIG. 8, FIG. 9, and FIG. 10. FIG. 8 is a schematic view of one switch 170 of the multifunctional core training device 100 of FIG. 1. FIG. 9 is a cross-sectional view of the switch 170 of FIG. 8 at a first position. FIG. 10 is a cross-sectional view of the switch 170 of FIG. 8 at a second position. Particularly, in the multifunctional core training device 100 of the present disclosure, the switch 170 can include a switch mainbody 171 and two magnet elements 172.

The switch mainbody 171 is disposed on the sliding base mainbody 163 and has a first end portion 173 and a second end portion 174, wherein the switch mainbody 171 includes a central pivot portion 175 and a protruding structure 176. As shown in FIG. 4, FIG. 8, FIG. 9, and FIG. 10, the central pivot portion 175 is pivotally disposed on the sliding base mainbody 163 of the sliding base 161, wherein the switch mainbody 171 pivots with the central pivot portion 175 as an axis center, and then the switch mainbody 171 is located relative to the sliding base 161 at the first position as shown in FIG. 9 or at the second position as shown in FIG. 10. The protruding structure 176 is disposed on the first end portion 173 so as to position the switch mainbody 171. The two magnet elements 172 are respectively disposed on the first end portion 173 and the second end portion 174.

In particular, as shown in FIG. 9, when the switch mainbody 171 is located relative to the sliding base 161 at the first position, the protruding structure 176 is corresponding inserted in the opening 165 of the sliding base mainbody 163 and is connected to the first frame body 110 so as to position the position of the sliding structure 160 relative to the first frame body 110. Further, in the multifunctional core training device 100, the first frame body 110 can further include a positioning hole 112, and the positioning hole 112 is located on the first frame body 110 close to the pivoting device 111. When the switch mainbody 171 is located relative to the sliding base 161 at the first position, the protruding structure 176 can pass through the opening 165 of the sliding base mainbody 163 and be disposed in the positioning hole 112, and the sliding structure 160 is positioned on the end different from the ground of the first frame body 110 (as shown in FIG. 7) so as to simulate the exercise mode of Roman chair on the market for training the core muscles.

Further, as shown in FIG. 10, when the switch mainbody 171 is located relative to the sliding base 161 at the second position, the second end portion 174 abuts against the sliding base mainbody 163. At the same time, the first end portion 173 is away from the sliding base mainbody 163, and the protruding structure 176 escapes from the opening 165 of the sliding base mainbody 163 and the positioning hole 112 of the first frame body 110. Therefore, the sliding structure 160 can move reciprocally along the major axis of the first frame body 110.

Furthermore, when the switch mainbody 171 is located relative to the sliding base 161 at the first position or the second position, the two magnet elements 172 can respectively stick to the first frame body 110 to further prevent the switch mainbody 171 from arbitrarily changing positions relative to the sliding base mainbody 163 during the exercise of the user, so that the usage safety of the multifunctional core training device 100 of the present disclosure can be enhanced. Moreover, a material of the first frame body 110 can include a magnetic metal material so as to facilitate the two magnet elements 172 sticking to the first frame body 110, and the usage safety of the multifunctional core training device 100 can be further enhanced.

Figure 11:
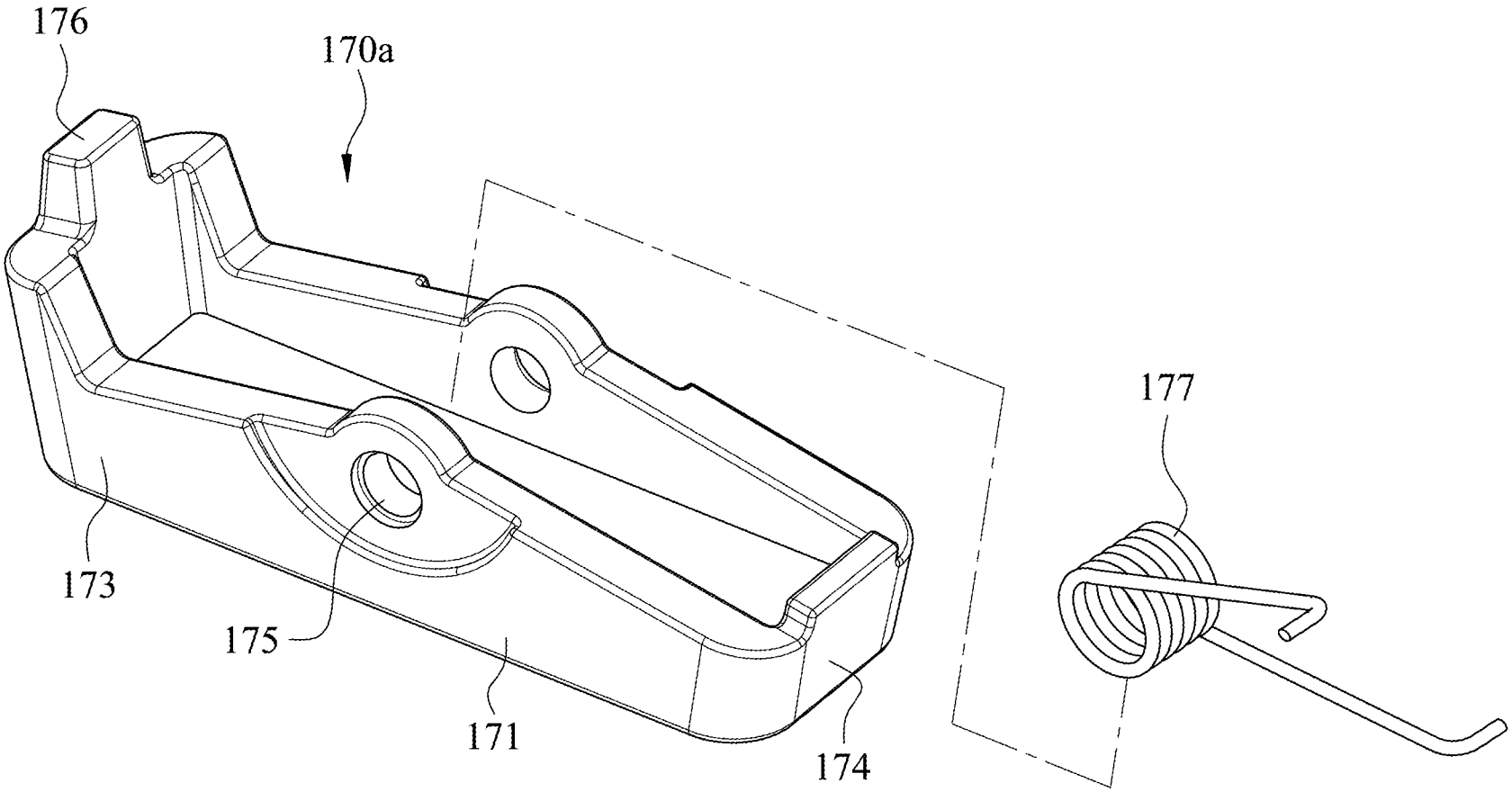
FIG. 11 is a schematic view of another switch of the multifunctional core training device of FIG. 1.
Figure 12:
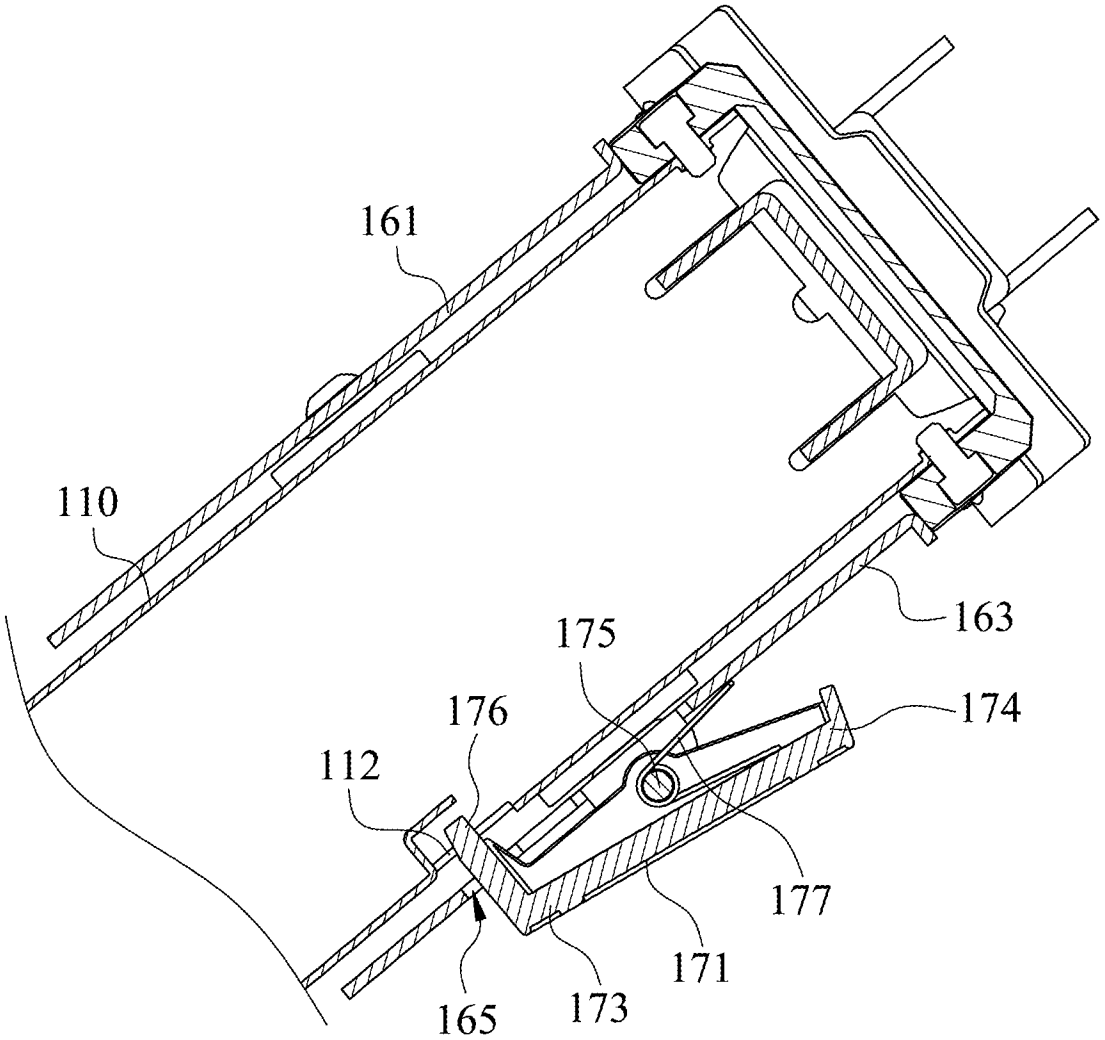
FIG. 12 is a cross-sectional view of the switch of FIG. 11 at the first position.
Figure 13:
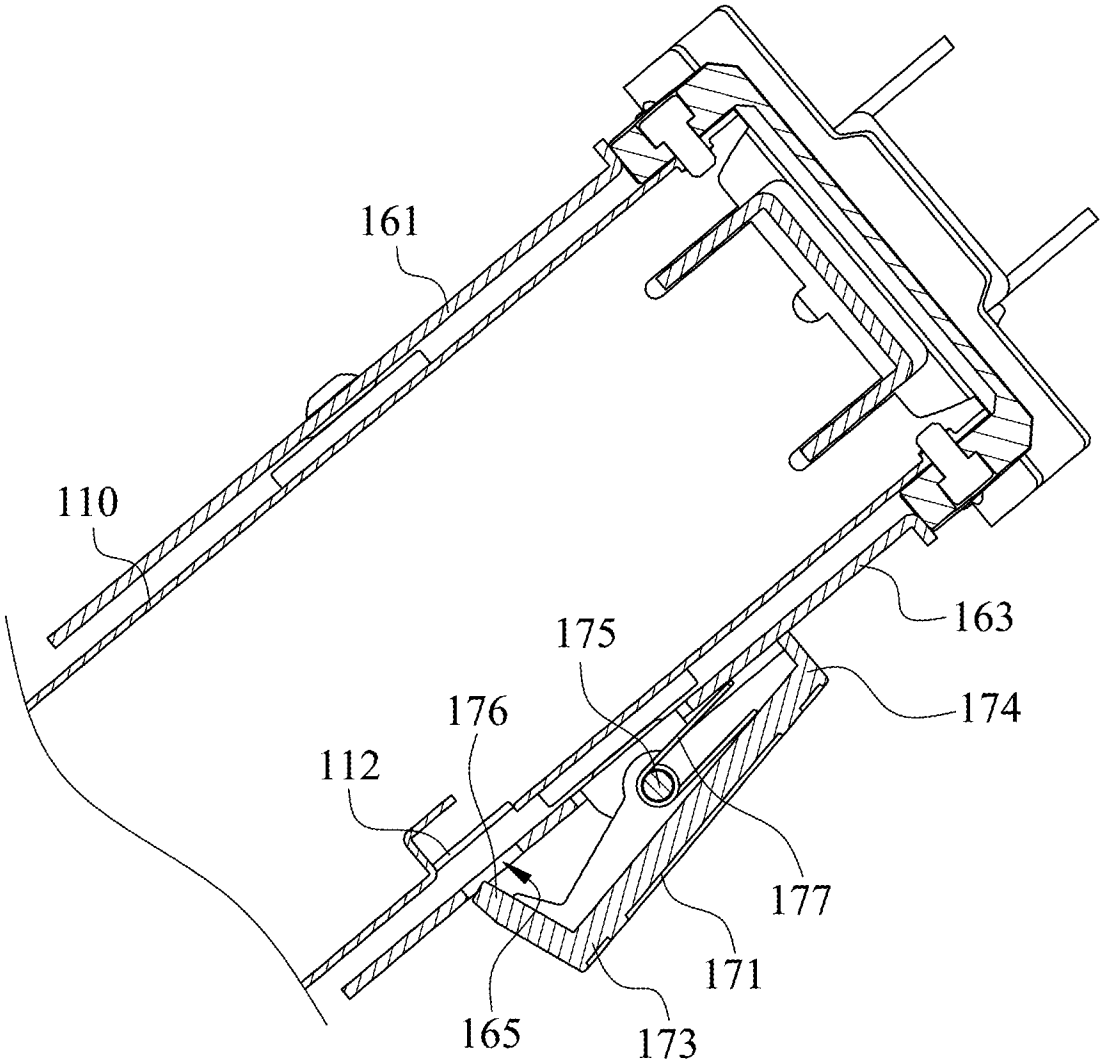
FIG. 13 is a cross-sectional view of the switch of FIG. 11 at the second position.

Reference is made to FIG. 11, FIG. 12, and FIG. 13. FIG. 11 is a schematic view of another switch **170*a* of the multifunctional core training device 100 of FIG. 1. FIG. 12 is a cross-sectional view of the switch 170*a* of FIG. 11 at the first position. FIG. 13 is a cross-sectional view of the switch 170*a* of FIG. 11 at the second position. Particularly, the multifunctional core training device 100 of the present disclosure can include the switch 170 or the switch 170*a* as required, and the details of the switch 170*a* are described below with reference to FIG. 1, FIG. 4, and FIG. 5. As shown in FIG. 11, the switch 170*a* can include a switch mainbody 171 and a switch elastic member 177**.

The switch mainbody 171 is disposed on the sliding base mainbody 163 and has a first end portion 173 and a second end portion 174, wherein the switch mainbody 171 includes a central pivot portion 175 and a protruding structure 176. As shown in FIG. 4, FIG. 11, FIG. 12, and FIG. 13, the central pivot portion 175 is pivotally disposed on the sliding base mainbody 163 of the sliding base 161, wherein the switch mainbody 171 pivots with the central pivot portion 175 as the axis center, and the switch mainbody 171 is located relative to the sliding base 161 at the first position as shown in FIG. 12 or at the second position as shown in FIG. 13. The protruding structure 176 is disposed on the first end portion 173 so as to position the switch mainbody 171. The switch elastic member 177 is disposed on the second end portion 174 of the switch mainbody 171, and two ends of the switch elastic member 177 respectively abut against the switch mainbody 171 and the sliding base mainbody 163.

As shown in FIG. 12, when the switch mainbody 171 is located relative to the sliding base 161 at the first position, the two ends of the switch elastic member 177 respectively abut against the switch mainbody 171 and the sliding base mainbody 163, and the protruding structure 176 is stably and correspondingly inserted in the opening 165 of the sliding base mainbody 163 and then is positioned in the positioning hole 112 of the first frame body 110 so as to position the sliding structure 160 to the end different from the ground of the first frame body 110 (referred to FIG. 7). Thus, the multifunctional core training device 100 of the present disclosure can simulate the exercise mode of Roman chair on the market for training the core muscles.

As further shown in FIG. 13, when the switch mainbody 171 is located relative to the sliding base 161 at the second position, the switch elastic member 177 is compressed by the press of the second end portion 174 of the switch mainbody 171. At the same time, the second end portion 174 abuts against the sliding base mainbody 163, and the first end portion 173 is away from the sliding base mainbody 163, so that the protruding structure 176 escapes from the opening 165 of the sliding base mainbody 163 and the positioning hole 112 of the first frame body 110. Thus, the sliding structure 160 can move reciprocally along the major axis of the first frame body 110. Furthermore, although it is not shown in the figures, a magnet member, a buckle, or other fastener can be disposed on the second end portion 174 of the switch mainbody 171, so that the second end portion 174 can stably abut against the sliding base mainbody 163. Furthermore, the switch elastic member 177 can be a torsion spring, but the present disclosure is not limited thereto.

Figure 14:
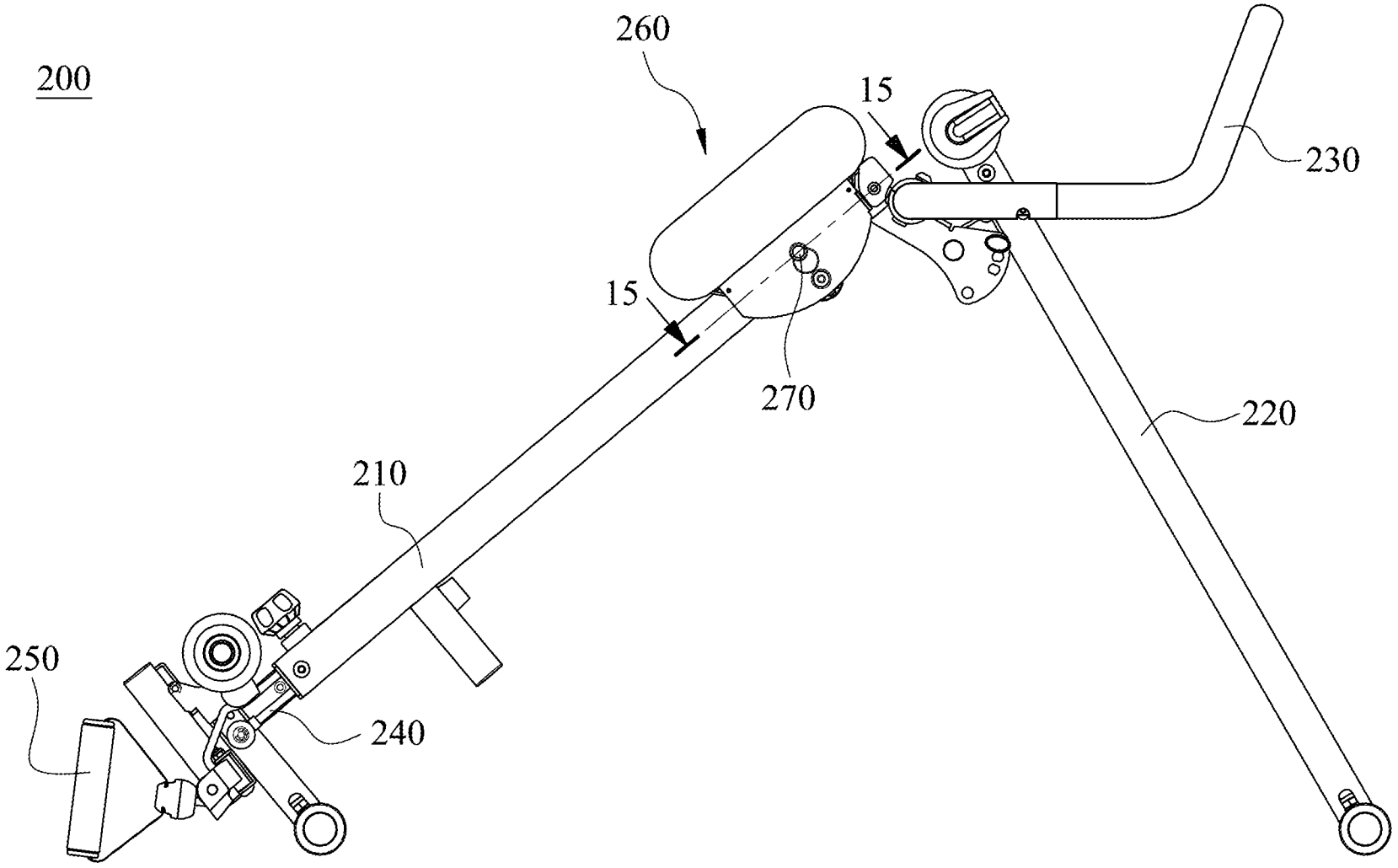
FIG. 14 is a schematic view of a multifunctional core training device according to the second embodiment of the present disclosure.
Figure 15:
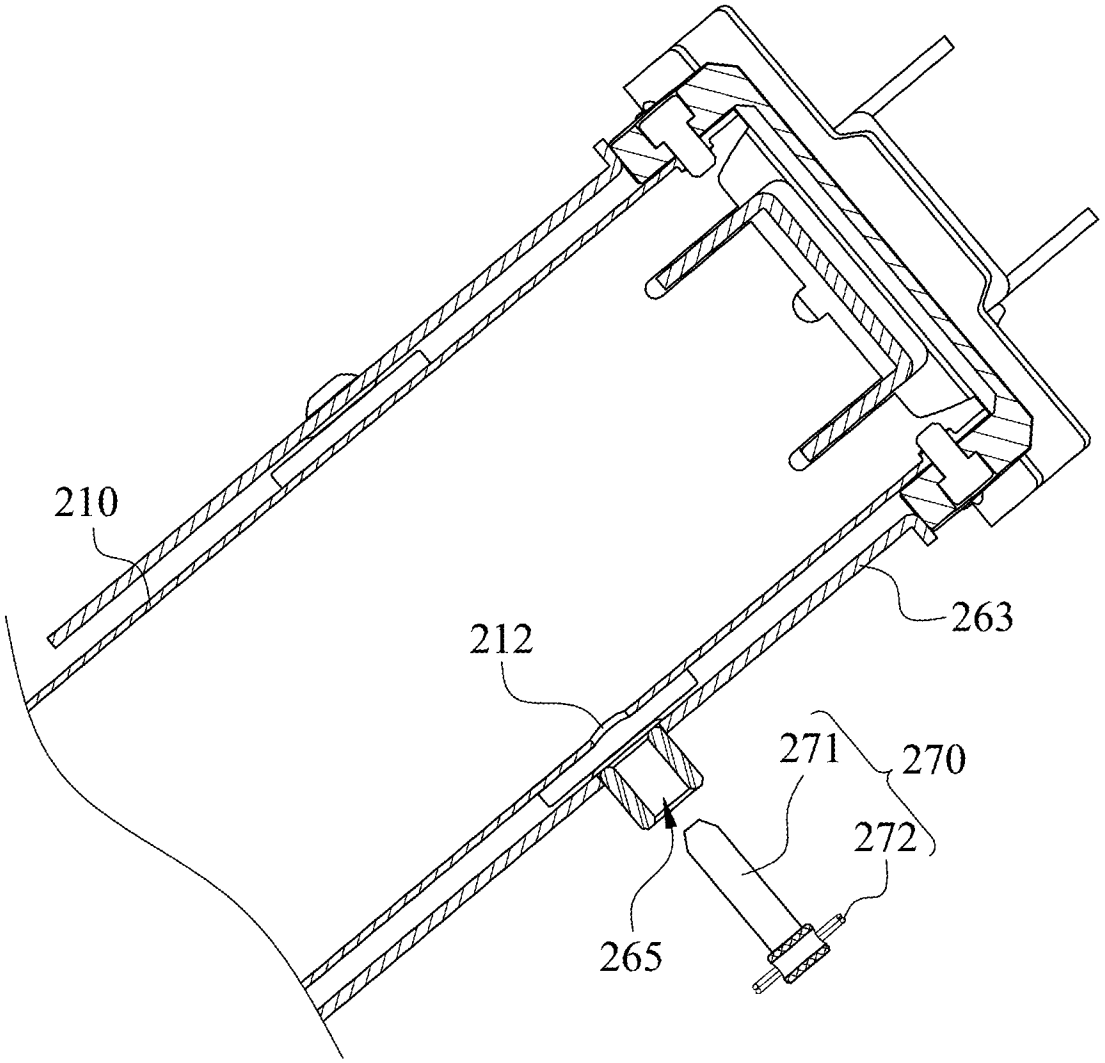
FIG. 15 is a cross-sectional view of the multifunctional core training device of FIG. 14 along Line 15-15.

Reference is made to FIG. 14 and FIG. 15. FIG. 14 is a schematic view of a multifunctional core training device 200 according to the second embodiment of the present disclosure. FIG. 15 is a cross-sectional view of the multifunctional core training device 200 of FIG. 14 along Line 15-15. The multifunctional core training device 200 includes a first frame body 210, a second frame body 220, a holding device 230, two elastic elements 240 (only one of the two elastic elements 240 is shown in FIG. 14), two forcing elements 250 (only one of the two forcing elements 250 is shown in FIG. 14), a sliding structure 260, and a switch 270, wherein the first frame body 210, the second frame body 220, the holding device 230, the two elastic elements 240, the two forcing elements 250 and the sliding structure 260 are similar in the structures of the first frame body 110, the second frame body 120, the holding device 130, the two elastic elements 140, the two forcing elements 150, and the sliding structure 160 of the multifunctional core training device 100, so that the details of the same elements are not described herein.

As shown in FIG. 14 and FIG. 15, the switch 270 includes a pin 271. The pin 271 is detachably inserted in the opening 265 of the sliding base mainbody 263 of the sliding structure 260 and the positioning hole 212 of the first frame body 210 in sequence so as to position the position of the sliding structure 260 relative to the first frame body 210. When the pin 271 is inserted in the opening 265 and the positioning hole 212 in sequence, the sliding structure 260 is positioned on one end different from the ground of the first frame body 210 so as to simulate the exercise mode of Roman chair on the market for training the core muscles.

Furthermore, the switch 270 can further include a pulling element 272. The pulling element 272 is connected to one end of the pin 271, wherein when the user wants to change the exercise mode of the Roman chair of the multifunctional core training device 200 to another exercise mode, the user can pull the pulling element 272, so that the pin 271 is pulled by the pulling element 272 and escapes from the positioning hole 212 of the first frame body 210 and the opening 265 of the sliding base mainbody 263. Then, the sliding structure 260 can move reciprocally along the major axis of the first frame body 210. Moreover, the pulling element 272 can be a pull ring, but the present disclosure is not limited thereto.

Figure 16:
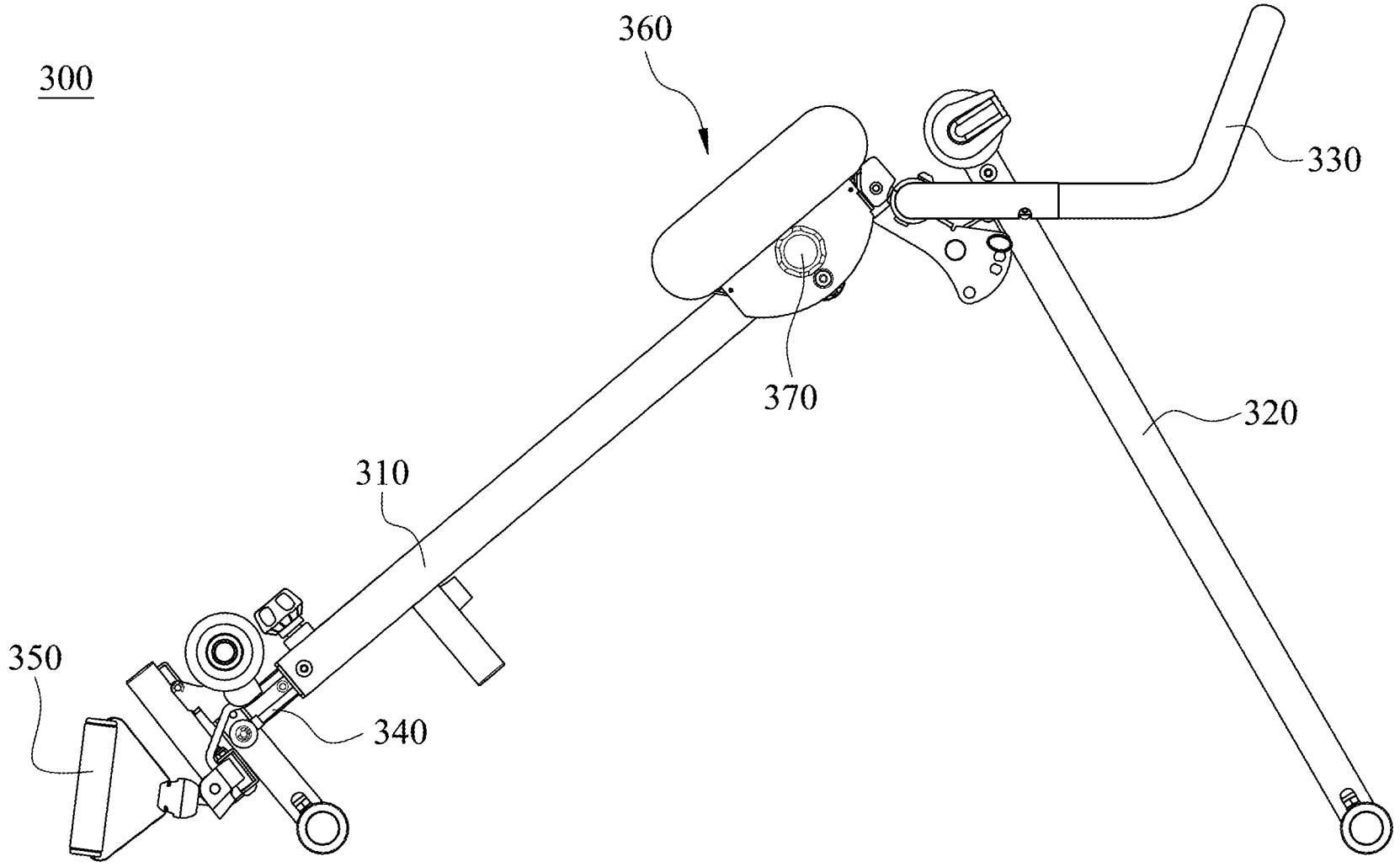
FIG. 16 is a schematic view of a multifunctional core training device according to the third embodiment of the present disclosure.
Figure 17:
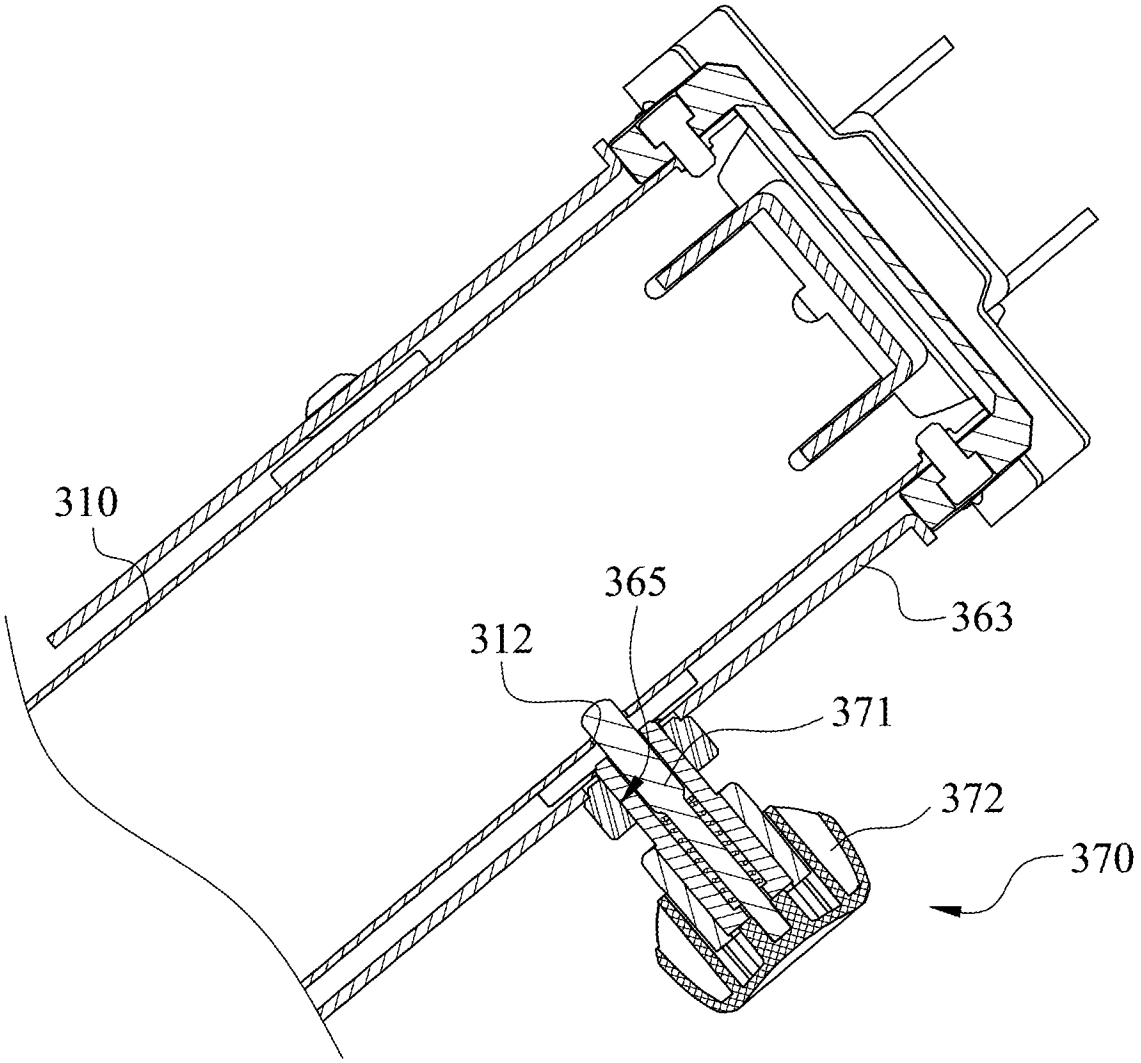
FIG. 17 is a schematic view of a switch of the multifunctional core training device of FIG. 16 in an open state.
Figure 18:
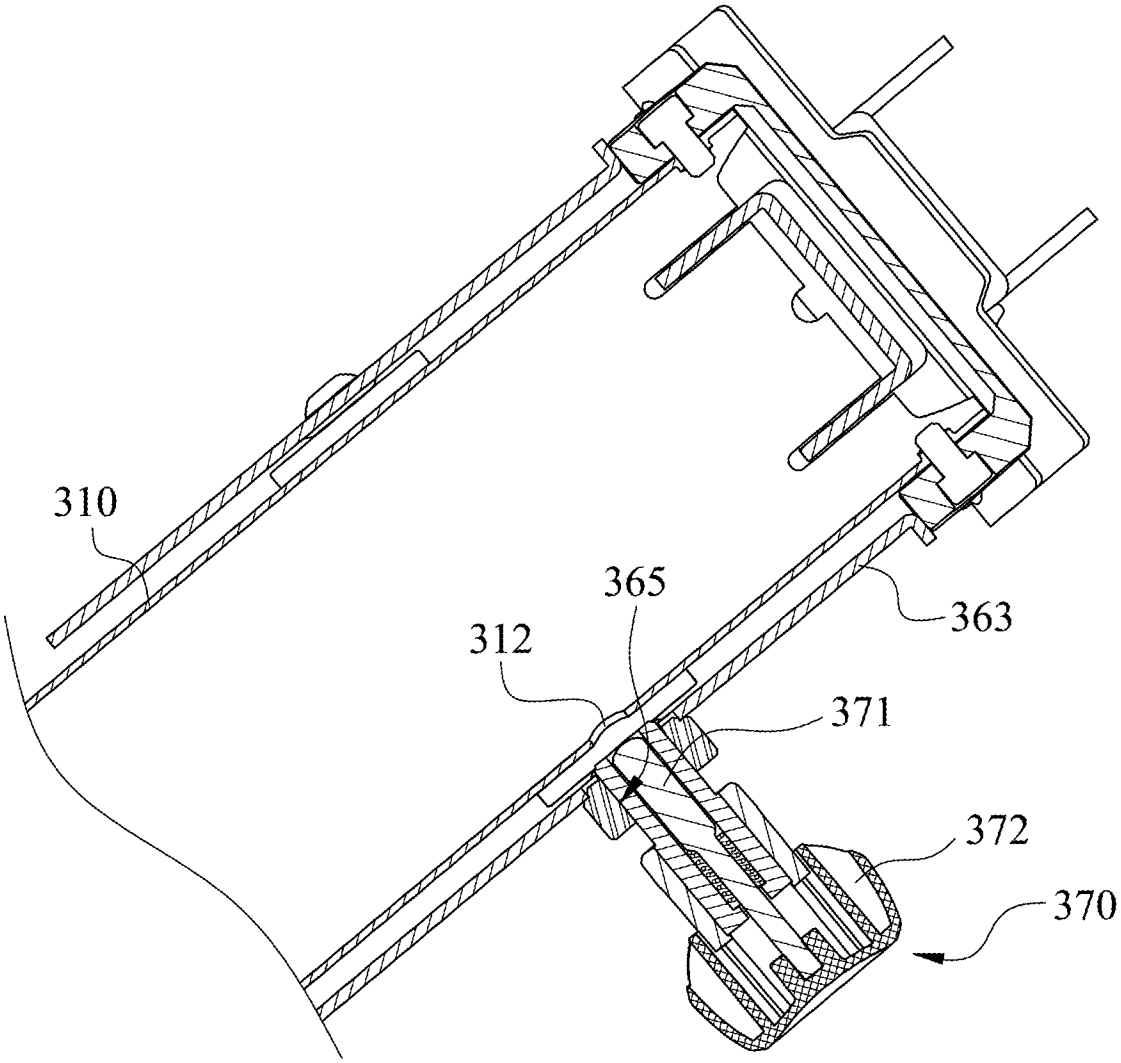
FIG. 18 is a schematic view of the switch of the multifunctional core training device of FIG. 16 in a closed state.

Reference is made to FIG. 16, FIG. 17, and FIG. 18. FIG. 16 is a schematic view of a multifunctional core training device 300 according to the third embodiment of the present disclosure. FIG. 17 is a schematic view of a switch 370 of the multifunctional core training device 300 of FIG. 16 in an open state. FIG. 18 is a schematic view of the switch 370 of the multifunctional core training device 300 of FIG. 16 in a closed state. The multifunctional core training device 300 includes a first frame body 310, a second frame body 320, a holding device 330, two elastic elements 340 (only one of the two elastic elements 340 is shown in FIG. 16), two forcing elements 350 (only one of the two forcing elements 350 is shown in FIG. 16), a sliding structure 360, and a switch 370, wherein the first frame body 310, the second frame body 320, the holding device 330, the two elastic elements 340, the two forcing elements 350, and the sliding structure 360 are similar in the structures of the first frame body 110, the second frame body 120, the holding device 130, the two elastic elements 140, the two forcing elements 150, and the sliding structure 160 of the multifunctional core training device 100, so that the details of the same elements are not described herein.

The switch 370 includes a spring pin 371. As shown in FIG. 17, when the switch 370 is in the open state, the spring pin 371 of the switch 370 is inserted in the opening 365 of the sliding base mainbody 363 of the sliding structure 360 and the positioning hole 312 of the first frame body 310 in sequence. At the same time, the position of the sliding structure 360 relative to the first frame body 310 is positioned, so that the sliding structure 360 is positioned on one end different from the ground of the first frame body 310 (as shown in FIG. 16) so as to simulate the exercise mode of Roman chair on the market for training the core muscles.

As further shown in FIG. 18, when the user wants to change the switch 370 from the open state to the closed state, the user can pull the spring pin 371 of the switch 370 to allow the spring pin 371 escaping from the positioning hole 312 of the first frame body 310, so that the positioning position of the sliding structure 360 relative to the first frame body 310 can be released, and then the sliding structure 360 can move reciprocally along the major axis of the first frame body 310.

Furthermore, the switch 370 can further include a controlling element 372. The controlling element 372 is connected to one end of the spring pin 371. When the user wants to change the exercise mode of the multifunctional core training device 300, the user can press or pull the controlling element 372 to allow the end of the spring pin 371 entering or escaping from the positioning hole 312 of the first frame body 310 so as to position or un-position the position of the sliding structure 360 relative to the first frame body 310. Therefore, the use of the multifunctional core training device 300 can be more convenient.

According to the aforementioned embodiments, the multifunctional core training device of the present disclosure has the advantages described bellowing.

First, by the arrangement that the second frame body pivots relative to the first frame body, and the sliding structure is movably disposed on the first frame body or is positioned on the first frame body by the switch, the exercise modes of the multifunctional core training device of the present disclosure can be changed according to the actual training needs, so that the multifunctional core training device of the present disclosure can be used as the rowing machine, the abdominal muscle training device, or the Roman chair to do exercise for training different muscles of the core muscles.

Second, by the arrangement that the switch includes the switch mainbody, and the protruding structure of the switch mainbody is disposed on the first end portion of the switch mainbody, the protruding structure can be corresponding inserted in the opening of the sliding base mainbody and be connected to the first frame body when the switch mainbody is located at the first position. Accordingly, the position of the sliding structure relative to the first frame body can be positioned, and the multifunctional core training device of the present disclosure can further be used as the Roman chair. Therefore, the multifunctional core training device of the present disclosure can be applied broadly.

Third, by the arrangement that the switch includes the two magnet elements, and the material of the first frame body includes the magnetic metal material, the two magnet elements can respectively stick to the first frame body when the switch mainbody is located relative to the sliding base at the first position or the second position. Therefore, position changing of the switch mainbody relative to the sliding base mainbody during exercise of the user can be further prevented, and the usage safety of the multifunctional core training device of the present disclosure can be enhanced.

Fourth, by the arrangement that the switch includes the pin, and the pin is detachably inserted in the opening of the sliding base mainbody and the positioning hole of the first frame body in sequence, the position of the sliding structure relative to the first frame body can be effectively positioned, so that the multifunctional core training device of the present disclosure can be further used as the Roman chair, and the breadth of applications thereof can be enhanced.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A multifunctional core training device, comprising:

a first frame body comprising a pivoting device;

a second frame body pivotally disposed on the first frame body and comprising a pivoting portion and a distal portion, and the pivoting portion pivotally disposed on the pivoting device;

a holding device disposed on one end portion of the first frame body;

two elastic elements disposed on the first frame body; and two forcing elements respectively connected to the two elastic elements, wherein each of the two forcing elements is connected to one end of one of the two elastic elements, and the other end of the one of the two elastic elements is connected to the first frame body;

a sliding structure movably disposed on the first frame body; and a switch disposed on the sliding structure, wherein the switch is for positioning a position of the sliding structure relative to the first frame body;

wherein when the second frame body pivots relative to the first frame body along a first circumferential direction with the pivoting device as an axis center, the distal portion of the second frame body gradually approaches the first frame body, so that the first frame body and the second frame body are arranged side by side, and then the sliding structure moves reciprocally along a major axis of the first frame body;

wherein when the second frame body pivots relative to the first frame body along a second circumferential direction with the pivoting device as the axis center, the distal portion of the second frame body is gradually away from the first frame body, so that the other end portion of the first frame body and the distal portion of the second frame body respectively abut against a ground, and then the sliding structure moves reciprocally along the major axis of the first frame body or is positioned on the first frame body.

2. The multifunctional core training device of claim 1, wherein the sliding structure comprises:

a sliding base, comprising:

a sliding base mainbody having an opening, and the sliding base mainbody movably disposed on the first frame body; and at least two pulleys disposed in the sliding base mainbody, and the at least two pulleys located between the sliding base mainbody and the first frame body; and a seat cushion disposed on the sliding base.

3. The multifunctional core training device of claim 2, wherein the switch comprises:

a switch mainbody disposed on the sliding base mainbody, wherein the switch mainbody has a first end portion and a second end portion, and the switch mainbody comprises:

a central pivot portion pivotally disposed on the sliding base mainbody, wherein the switch mainbody pivots with the central pivot portion as an axis center, and then the switch mainbody is located relative to the sliding base at a first position or a second position; and a protruding structure disposed on the first end portion;

wherein when the switch mainbody is located relative to the sliding base at the first position, the protruding structure is corresponding inserted in the opening of the sliding base mainbody and is connected to the first frame body so as to position the position of the sliding structure relative to the first frame body;

wherein when the switch mainbody is located relative to the sliding base at the second position, the second end portion abuts against the sliding base mainbody, and then the sliding structure moves reciprocally along the major axis of the first frame body.

4. The multifunctional core training device of claim 3, wherein the first frame body further comprises a positioning hole, and the protruding structure passes through the opening of the sliding base mainbody and is disposed in the positioning hole.

5. The multifunctional core training device of claim 3, wherein the switch further comprises:

two magnet elements respectively disposed on the first end portion and the second end portion.

6. The multifunctional core training device of claim 5, wherein a material of the first frame body comprises a magnetic metal material.

7. The multifunctional core training device of claim 4, wherein the switch further comprises:

a switch elastic member, wherein two ends of the switch elastic member respectively abut against the switch mainbody and the sliding base mainbody.

8. The multifunctional core training device of claim 7, wherein the switch elastic member is a torsion spring.

9. The multifunctional core training device of claim 2, wherein the switch comprises a pin, the first frame body further comprises a positioning hole, and the pin is detachably inserted in the opening of the sliding base mainbody and the positioning hole of the first frame body in sequence so as to position the position of the sliding structure relative to the first frame body.

10. The multifunctional core training device of claim 9, wherein the pin is a spring pin.

11. The multifunctional core training device of claim 1, further comprising:

two supporting rods, wherein one of the two supporting rods is disposed on the other end portion of the first frame body, and the other one of the two supporting rods is disposed on the distal portion of the second frame body.

12. The multifunctional core training device of claim 1, further comprising:

a handle member disposed on the second frame body and close to the pivoting portion.

13. The multifunctional core training device of claim 12, wherein the handle member comprises:

two supporting elements respectively disposed on two ends of the handle member.

14. The multifunctional core training device of claim 1, further comprising:

a positioning rod disposed on one side different from the sliding structure of the first frame body, wherein when the first frame body and the second frame body are arranged side by side, two ends of the positioning rod respectively abut against the first frame body and the second frame body.

15. The multifunctional core training device of claim 1, wherein the first frame body further comprises:

a housing element having a through hole;

a first frame element telescopically disposed in the housing element, and the first frame element comprising at least two penetrating holes; and a positioning element passing through the through hole and one of the at least two penetrating holes in sequence.

16. The multifunctional core training device of claim 15, wherein the two elastic elements extend along the major axis of the first frame body and are disposed in the housing element.

* * * * *